United States Patent [19]

Yoshida et al.

[11] Patent Number: 4,560,407

[45] Date of Patent: Dec. 24, 1985

[54] ALLOY FOR USE IN A RADIOACTIVE RAY ENVIRONMENT AND REACTOR CORE MEMBERS

[75] Inventors: Toshimi Yoshida, Katsuta; Kiyotomo Nakata, Hitachi; Isao Masaoka, Hitachi; Hisawo Itow, Hitachi, all of Japan

[73] Assignee: Hitachi, Ltd., Tokyo, Japan

[21] Appl. No.: 358,211

[22] Filed: Mar. 15, 1982

[30] Foreign Application Priority Data

Mar. 20, 1981 [JP] Japan ..... 56-40666
Sep. 9, 1981 [JP] Japan ..... 56-141034

[51] Int. Cl.[4] ..... C22C 39/14

[52] U.S. Cl. ..... 75/128 N; 75/128 W; 148/38; 376/900

[58] Field of Search ..... 75/126 C, 126 J, 128 N, 75/128 W; 148/38; 376/900

[56] References Cited

U.S. PATENT DOCUMENTS 2,602,737 7/1952 Binder et al. ..... 75/128 N
3,563,728 2/1971 Allio et al. ..... 75/128 N
3,856,517 12/1974 Bates et al. ..... 75/128 N

FOREIGN PATENT DOCUMENTS 00472325 4/1979 Japan ..... 75/128 N

OTHER PUBLICATIONS

J. F. Bates, Irradiation—Induced Swelling Variations Resulting from Compositional Modifications of Type 316 Stainless Steel, pp. 371–379, 1975.

Bäumel et al., "Entwicklung, Verarbeitung und Einsotz des Stickstofflegierten, Hochmolybdänhaltigen Stahles X3 CrNiMoN 17 13 5", in *Werkstoffe und Korrosion*, 11–72, pp. 973–983.

*Primary Examiner*—L. Dewayne Rutledge
*Assistant Examiner*—Debbie Yee
*Attorney, Agent, or Firm*—Antonelli, Terry & Wands

[57] ABSTRACT

An alloy for use in an environment exposed to neutron rays consists principally of Cr-Ni austenite stainless steel containing nitrogen in an amount exceeding the amount of an impurity and having principally an austenite structure. The alloy is used for reactor core members such as a core shroud, core supporters, control rods, etc. which are exposed to the neutron radiation but prevented from being embrittled by the radiation.

2 Claims, 7 Drawing Figures

0.82dpa 0.84dpa

ALLOY FOR USE IN A RADIOACTIVE RAY ENVIRONMENT AND REACTOR CORE MEMBERS

BACKGROUND OF THE INVENTION

This invention relates to a novel alloy for use in an environment exposed to radioactive rays, especially to the neutron rays, and more specifically to austenite steel for use in a nuclear reactor and reactor core members.

Reactor core members such as core supportors, a core shroud, control rods, etc. disposed inside a nuclear reactor are used while being exposed to the neutron radiation. When they received the neutron rays, there takes place damage to materials due to the neutron radiation, whereby they markedly change their characteristics. Deterioration of the material characteristics exerts critical influences upon the safety the reliability of the reactor. Therefore, the reactor core member material must be selected taking such things into account.

In light-water reactors, it is feared that the material of internal instrument and appliance would undergo radiation-embrittlement during operation due to the neutron radiation. Besides embrittlement due to the neutron radiation, an SCC phenomenon in water at high temperature and high pressure must also be taken into account in selecting the material for the core.

In fast breeder reactors, damage to a fuel covering tube, a core tube or the like has specifically been a critical problem. In this reactor, the temperature of the coolant (liquid sodium) is relatively high, e.g., 350° to 500° C., and moreover, the amount of high speed neutron radiation is by far greater than in the light-water reactors. Therefore, voids occur on the material exposed to the neutron radiation, thus causing a serious problem of swelling (of volume).

In fusion reactors, the neutron radiation in such high energy as to be incomparable to that in fission reactors would take place. Hence, a first wall material encompassing the plasma is exposed to severe radiation damages. In this instance, damage due to gas atoms (hydrogen and helium atoms) generated by the nuclear conversion becomes an extremely critical problem, in addition to the abovementioned swelling phenomenon.

As for swelling prevention of the core material exposed to neutron rays, there are various proposals. For example, in Japanese Laid-open Patent Application No. 54-36498, austenite stainless steel including titanium, niobium and carbon is disclosed, and in Japanese Laid-open Patent Application No. 54-84197, there is disclosed a method of treatment of austenite stainless steel, wherein the austenite stainless steel is subjected to solid solution treatment at a temperature from 950° to 1200° C. after being finally formed, and after then, to aging treatment at a temperature of about 600° to 800° C. for about 50 hours.

SUMMARY OF THE INVENTION

An object of the invention is to provide an alloy for use in an environment exposed to radioactive rays and having high radiation resistance, and reactor core members.

The characterizing feature of the present invention resides in an alloy for use in an environment exposed to radioactive rays, the alloy containing nitrogen in an amount exceeding the amount of an impurity. The term "environment exposed to radioactive rays" herein denotes an environment that is exposed to neutron radiation of at least $10^{16}$ nvt, and more preferably, at least $10^{20}$ nvt. The environment in the reactor core is most suitable.

The substance for adding nitrogen is preferably an alloy which contains large quantities of nitrogen in the base alloy or in an alloy element to be added to the base alloy. The amount of nitrogen to be added preferably exceeds the amount of an impurity and is especially such an amount that does not substantially permit the formation of a nitride in the alloy. Preferably, nitrogen substantially exists in the alloy in the form of solid solution.

The abovementioned alloy primarily consists of Cr-Ni austenite steel containing nitrogen in an amount exceeding the amount of an impurity and having an austenite structure. In this case, the amount of nitrogen is preferably from 0.05 to 0.2 wt%.

Preferably, the abovementioned austenite steel comprises principally Fe, contains up to 0.03 wt% C, up to 1 wt % Si, up to 2 wt % Mn, 15 to 25 wt % Cr, 8 to 35 wt % Ni and 0.05 to 0.2 wt % N and has primarily an austenite structure. Especially preferred is austenite steel having a full austenite structure.

It has conventionally been feared that nitrogen contained in the austenite steel would result in helium damage caused in a high temperature range due to the helium atoms generated by the nuclear reaction upon neutron radiation. Hence, measures have been taken in order to reduce the nitrogen content.

However, the inventors of the present invention have examined in detail the influences of nitrogen upon the radiation damage by use of a ultra-high voltage electron microscope and have found that, on the contrary, the nitrogen atom tends to reduce the damage by means of the atoms between the lattice introduced by the radiation and by means of the interaction between crystal defects such as the void points and the nitrogen atoms.

In other words, the inventors have clarified that when nitrogen is added, the austenite steel exhibits higher radiation resistance.

For example, when irradiated with neutrons in doses of at least $10^{23}$ n/m$^2$ (0.1 MeV), stainless steel (the SUS 304) stretches less than when it is not irradiated with neutrons. Through a study for developing materials that have resistance against the neutron radiation and that may substitute for the SUS 304, the inventors have discovered the fact that stainless steels are made brittle by neutron radiation chiefly due to dislocation loops formed in the stainless steel by the neutron radiation, and they have thus attempted to control the dislocation loops that are formed by the neutron radiation by using an austenite stainless steel containing not more than 0.03% carbon and 0.05 to 0.15 wt % nitrogen.

Next, the chemical components of the austenite steel as the material of the present invention will be described.

From the aspect of radiation resistance, precipitation of C as a carbide is not preferred. Hence, the carbon content is preferably low so as to prevent precipitation of the carbide. For increasing SCC resistance (in the environment of pure water at high temperature and high pressure in the light-water reactor), too, the carbon content is preferably such that it does not permit precipitation of the carbide. In view of these factors, the carbon content is preferably up to 0.03%, more preferably up to 0.01% and especially preferably, from 0.003 to 0.01%.

To reduce radiation damage, the N content is preferably at least 0.025%. If the N content is increased, the effect is also increased but the presence of a large N content tends to permit formation of a nitride. Precipitation of the nitride reduces the solid solution N content in the matrix and forms a Cr nitride, thus exerting adverse influences upon SCC resistance. For these reasons, it is preferred that the N content is only up to 0.2%, and more preferably, from 0.05 to 0.15%. In order to make up for the decrease in strength due to the decrease in the C content by the addition of N, the total amount of C and N is preferably at least 0.09%.

In addition to the abovementioned C and N contents, impurity elements such as P, S and the like are also contained.

More definitely, austenite stainless steel, to which 1 to 3% Mo is added, is suitable. Besides the abovementioned C and N contents, the ranges of the chemical components for this steel are Cr: 15–20%, Ni: 10–15%, Mo: 2–3%.

The material of the present invention is used in the form with a full austenite structure after solid solution treatment but it may also be used in the form after cold work subsequent to the solid solution treatment.

The abovementioned alloy comprises at least a Ni base alloy containing nitrogen in an amount exceeding the amount of an impurity and Cr in such an amount as not to permit the formation of a substantial phase. Preferably, nitrogen is from 0.05 to 0.15% and Cr, from 15 to 25%. The Ni base alloy may contain considerable amounts of elements such as Mo, W, Al, Ti, Nb, Zr and the like.

The abovementioned alloy consists of low alloy steel containing nitrogen in an amount exceeding the amount of an impurity and having primarily ferrite-pearlite structure or primarily bainite structure. Preferably, the nitrogen content is from 0.05 to 0.15%. The low alloy steel may contain considerable amounts of Cr, Mo, W, V, Cu, Ni and the like.

In the present invention, the austenite stainless steel serves as a material for forming reactor core members including machine parts that receive neutron irradiation in reactor cores. Here, all of the core members disposed in the portions subject to neutron radiation need not be made of the austenite stainless steel. Only those core members disposed in the portions subject to receive particularly intense neutron irradiation may be made of the austenite stainless steel.

For example, the SUS 304 which had hitherto been used for the reactor cores stretches less when it is irradiated with neutrons in doses of at least $10^{23}$ n/m$^2$ (0.1 MeV), compared with when it is not irradiated with neutrons. Therefore, core members disposed in the places irradiated with neutrons in doses of at least $10^{23}$ n/m$^2$ (0.1 MeV), such as control rods, neutron counter tubes, core supporters, core shrouds, neutron source pipes, etc., should be made of the austenite stainless steel.

DESCRIPTION OF THE PREFERRED EMBODIMENT

Example

The chemical compositions of the samples used are tabulated in the following table. Sample No. 1 is a comparative material and sample No. 2 is the material of the present invention. The carbon content is substantially the same in Nos. 1 and 2, but their nitrogen contents are remarkably different.

Each sample was subjected to solid solution treatment by heating at 1,050°–1,100° C. for 30 minutes and then electrolytically polished. Electron radiation was effected with a ultra-high voltage electron microscope. Neutron radiation damage corresponding to approximately $5\times10^{23}$ n/cm$^2$ was applied at a work voltage of 1,000 keV to observe the rearrangement structure formed in the sample and the forming condition of voids. The results are shown in FIGS. 1 and 2.

Figure 1:
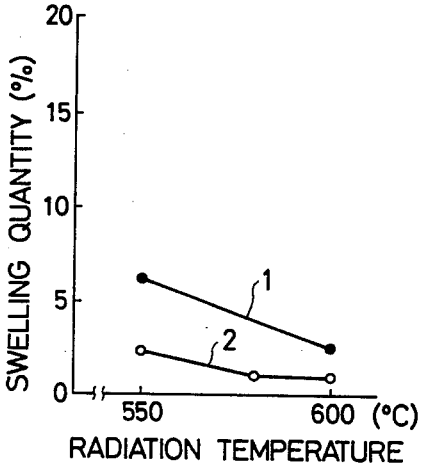
FIG. 1 is a diagram showing the relation between the amount of swelling and the radiation temperature.
Figure 2:
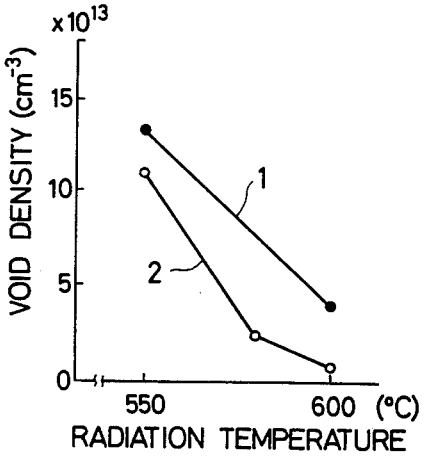
FIG. 2 is a diagram showing the relation between the void density and the radiation temperature.

FIGS. 1 and 2 are diagrams showing the relation between the swelling quantity and the radiation temperature and between the void density and the radiation temperature, respectively.

As shown in FIG. 1, sample No. 2 having a higher N content exhibits less swelling than sample No. 1. This is also represented clearly in the difference of the void density shown in FIG. 2. As can be appreciated, the presence of nitrogen serves to restrict swelling due to the void formation and addition of nitrogen is extremely effective for improving radiation resistance.

| No. | | C | Si | Mn | P | S | Cr | Ni | Mo | N |
|---|---|---|---|---|---|---|---|---|---|---|
| 1 | Comparative material | 0.005 | 0.38 | 1.83 | 0.007 | 0.008 | 17.2 | 14.3 | 2.4 | 0.018 |
| 2 | Material of this invention | 0.006 | 0.38 | 1.81 | 0.009 | 0.008 | 17.5 | 14.5 | 2.4 | 0.086 |

Figure 3A:
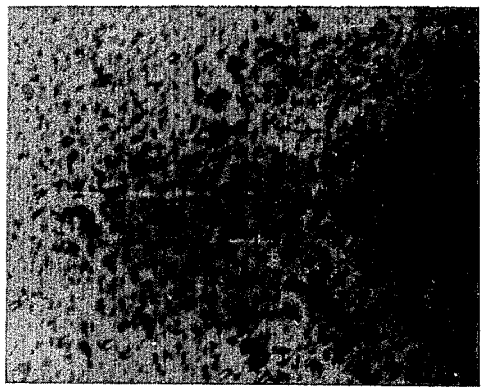
FIGS. 3(A) and 3(B) are electron microphotographs of the section of specimens to illustrate the formation of dislocation loops by the neutron radiation.
Figure 3B:
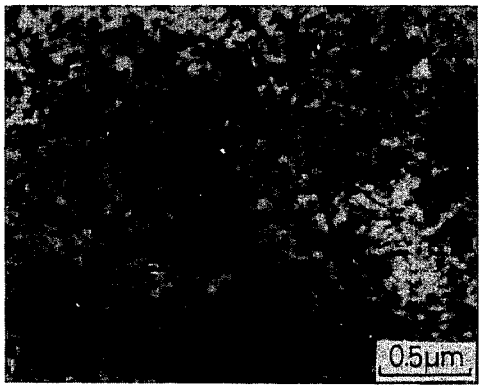

Further, specimens having the same content as above were subjected to solution treatment at 1050° C. for 15 minutes, and irradiated with electrons in an ultrahigh-voltage electron microscope (acceleration voltage 1 MV). FIGS. 3(A) and 3(B) show the formation of dislocation loops when the specimens No. 2 and No. 1 are irradiated at a rate of $4.8\times10^{23}$ e/sec ($2.2\times10^{-3}$ dpa/sec) which corresponds to a neutron radiation of $1\times10^{27}$ n/m$^2$ at a temperature of 500° C. Specimen No. 2 (FIG. 3(A)) which contains a large amount of nitrogen only permits the dislocation loops to grow very little compared with specimen No. 1 (FIG. 3(B)), which indicates that it is embrittled very little.

Figure 4:
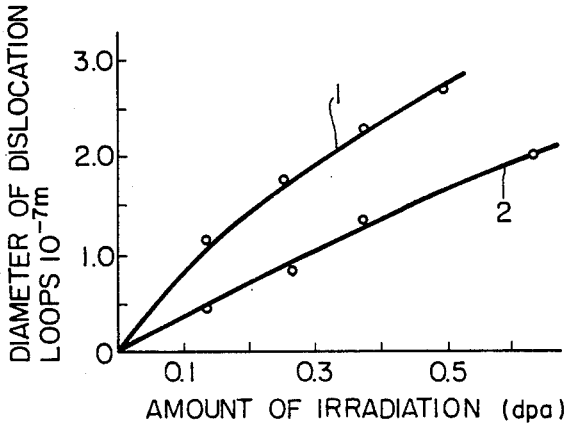
FIGS. 4 and 5 are diagrams illustrating relations between the growth of dislocation loops and the radiation dose of neutron when the specimens are irradiated at temperatures of 470° C. and 550° C.
Figure 5:
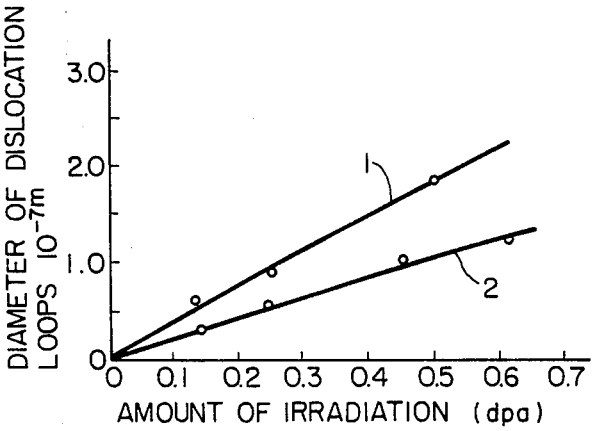

FIGS. 4 and 5 illustrate relations between the growth of dislocation loops and the radiation dose when the specimens are irradiated at a temperature of 550° C. and at a temperature of 470° C., respectively. In the specimen No. 2, the growth of dislocation loops is restrained even when it is irradiated at 470° C. or at 550° C. By adding nitrogen to the austenite stainless steel, therefore, the core members made of the austenite-type stainless steel can be prevented from being brittled by the irradiation with neutrons.

Though the behaviour of the material damage due to electron radiation is different from that due to neutron radiation, the material of the present invention can be expected to show excellent radiation resistance to neutron radiation from comparison of the degree of damage of the conventional materials.

Figure 6:
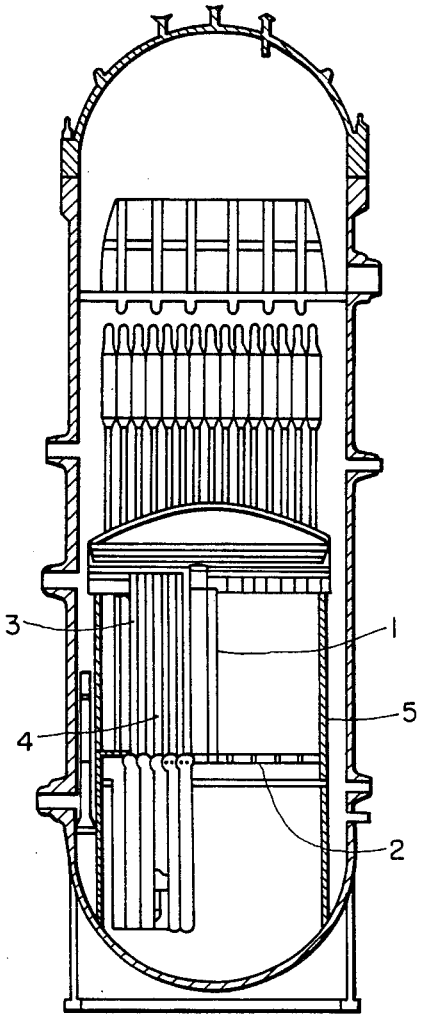
FIG. 6 is a section view schematically showing the constructon of a reactor core according to an embodiment of the present invention.

FIG. 6 is a section view schematically showing the core of a BWR-type reactor, in which reference numeral 1 denotes neutron source pipes, 2 a core support member, 3 neutron counter tubes, 4 control rods and 5 a core shroud. These core members are subjected to intense neutron radiation, and hence are made of the austenite stainless steel which contains not more than 0.03% by weight of carbon and 0.05 to 0.15% by weight of nitrogen. It is, of course, allowable to make other fine parts using the austenite stainless steel, in addition to the core members denoted by 1 to 5.

Further, the abovementioned material can be used for, for example, a core shroud, core supporters, control rods, etc. of PWR type reactor core, fuel pins, wrapper tubes, etc. of FBR type reactor core, etc..

Thus, when the material according to the invention is used for core members exposed to neutron radiation, they are effectively prevented from being embrittled by the neutron radiation. Therefore, the reliability of the reactor core is increased, and the life of the members or machine parts can be lengthened.

As described in the foregoing, the present invention provides an alloy having excellent radiation resistance, and outstanding effects can be obtained by applying the alloy to core members such as internal instruments and appliances of reactors.

What is claimed is:

1. A reactor core member made of an austenite stainless steel and installed in the core portion exposed to neutron radiation of at least $10^{16}$ nvt, said austenite stainless steel having a full austenite structure and consisting essentially of not more than 0.03% by weight of carbon, 0.05 to 0.2% by weight of nitrogen, 15 to 20% by weight of chromium, 10 to 15% by weight of nickel, 2.0 to 3.0% by weight of molybdenum, up to 1% by weight of silicon, up to 2% by weight of manganese, and the balance iron, the nitrogen acting to reduce radiation damage of the steel, whereby embrittlement of the member by neutron radiation is substantially prevented.

2. A reactor core member made of an austenite stainless steel and installed in the core portion exposed to neutron radiation of at least $10^{16}$ nvt, said austenite-type stainless steel having a full austenite structure consisting essentially of 0.006 wt% C, 0.38 wt% Si, 1.81 wt% Mn, 17.5 wt% Cr, 14.5 wt% Ni, 2.4 wt% Mo, 0.086 wt% N and the balance Fe, the nitrogen acting to reduce radiation damage of the steel, whereby embrittlement of the member by neutron radiation is substantially prevented.

* * * * *